US009717956B2

(12) United States Patent
DuFaux et al.

(10) Patent No.: US 9,717,956 B2
(45) Date of Patent: Aug. 1, 2017

(54) STIFF CORE GOLF BALL AND METHODS OF MAKING SAME

(71) Applicant: OnCore Golf Technology, Inc., Buffalo, NY (US)

(72) Inventors: Douglas P. DuFaux, Orchard Park, NY (US); Keith A. Blakely, Buffalo, NY (US)

(73) Assignee: OnCore Golf Technology, Inc., Buffalo, NY (US)

( * ) Notice: Subject to any disclaimer, the term of this patent is extended or adjusted under 35 U.S.C. 154(b) by 0 days.

(21) Appl. No.: 15/030,624

(22) PCT Filed: Oct. 20, 2014

(86) PCT No.: PCT/US2014/061367

§ 371 (c)(1),
(2) Date: Apr. 20, 2016

(87) PCT Pub. No.: WO2015/058190

PCT Pub. Date: Apr. 23, 2015

(65) Prior Publication Data

US 2016/0279482 A1 Sep. 29, 2016

Related U.S. Application Data

(60) Provisional application No. 61/893,268, filed on Oct. 20, 2013.

(51) Int. Cl.

| | |
|---|---|
| ***A63B 37/04*** | (2006.01) |
| ***A63B 37/00*** | (2006.01) |
| ***A63B 45/00*** | (2006.01) |

(52) U.S. Cl.

CPC ..... *A63B 37/0065* (2013.01); *A63B 37/006* (2013.01); *A63B 37/0051* (2013.01); *A63B 37/0052* (2013.01); *A63B 37/0054* (2013.01); *A63B 37/0061* (2013.01); *A63B 37/0069* (2013.01); *A63B 37/0074* (2013.01); *A63B 37/0075* (2013.01); *A63B 37/0076* (2013.01); *A63B 45/00* (2013.01); *A63B 37/0078* (2013.01)

(58) Field of Classification Search

CPC ..... A63B 37/0051; A63B 37/0054; A63B 37/0069

See application file for complete search history.

(56) References Cited

U.S. PATENT DOCUMENTS

| | | | | |
|---|---|---|---|---|
| 6,004,225 | A * | 12/1999 | Owens | A63B 37/04 473/354 |
| 6,705,957 | B2 | 3/2004 | Owens et al. | |
| 6,976,925 | B2 | 12/2005 | Owens et al. | |
| 2002/0022537 | A1 | 2/2002 | Nesbitt et al. | |

(Continued)

OTHER PUBLICATIONS

Compressions by any other name—J. Dalton.*

*Primary Examiner* — John E Simms, Jr.
(74) *Attorney, Agent, or Firm* — Hodgson Russ LLP

(57) ABSTRACT

A golf ball is provided that has a spherical core exhibiting a stiffness from 400 MPa to 200 GPa. The stiffness of the core may be controlled by adjusting the materials of construction and the ratio of the materials. This results in a golf ball that is legal for play and capable of drive distances essentially equivalent to those of currently-available high performance golf balls, but also provides a golf ball that has less hook and slice during play.

11 Claims, 2 Drawing Sheets

(56) References Cited

U.S. PATENT DOCUMENTS

| | | | | |
|---|---|---|---|---|
| 2005/0159524 | A1* | 7/2005 | Rajagopalan | A63B 37/08 524/432 |
| 2006/0252579 | A1 | 11/2006 | Umezawa et al. | |
| 2008/0057332 | A1 | 3/2008 | Owens et al. | |
| 2008/0171616 | A1* | 7/2008 | DuFaux | A63B 37/0003 473/373 |
| 2008/0207354 | A1* | 8/2008 | DuFaux | A63B 37/0003 473/373 |
| 2009/0011865 | A1* | 1/2009 | Sullivan | A63B 37/0003 473/376 |
| 2011/0312445 | A1* | 12/2011 | Sullivan | A63B 37/0043 473/376 |
| 2012/0100936 | A1 | 4/2012 | Sullivan et al. | |
| 2013/0090188 | A1* | 4/2013 | Okabe | A63B 37/0075 473/377 |
| 2013/0260150 | A1* | 10/2013 | Grivei | C01B 31/04 428/402 |

* cited by examiner

STIFF CORE GOLF BALL AND METHODS OF MAKING SAME

CROSS-REFERENCE TO RELATED APPLICATIONS

This application claims priority to the provisional patent application filed Oct. 20, 2013 and assigned U.S. App. No. 61/893,268, the disclosure of which is hereby incorporated by reference.

FIELD OF THE DISCLOSURE

This disclosure relates to a golf ball with improved play characteristics and, more particularly, a golf ball with a stiff core.

BACKGROUND OF THE DISCLOSURE

Most golf balls sold in the U.S. are listed on the conforming list of the United States Golf Association (USGA). Several specifications have been established by the USGA and a golf ball must meet certain test criteria relating to these specifications for weight, size, initial velocity, overall distance (carry and roll), and spherical symmetry. For acceptance by the USGA, a golf ball must not weigh more than 1.620 ounces, must have a minimum diameter of 1.680 inches, must have a maximum initial ball velocity of 250 feet per second (plus a maximum 2% tolerance) as measured on a standard USGA ball testing machine, and must have an overall distance maximum of 317 yards (plus a maximum 3 yard tolerance) as measured by the USGA overall distance test procedure. Further, the ball must not be designed, manufactured, or intentionally modified to have properties that differ from those of a spherically symmetric ball. The USGA tests for symmetry by inspecting the statistical deviation of the overall distance test data (distance variation and flight time variation) when the ball is struck from various aspects.

A typical golf ball is either of the "wound" or "molded" type. Since molded golf balls are cheaper to produce, virtually all of the golf balls currently sold are molded. Due to their price, most golf balls sold today are two-piece polymeric balls with polybutadiene cores. The process of making this type of ball includes compression molding the polybutadiene into a solid core of various diameters and then injection molding a cover onto this core. Dimples are included in the die and so the second step of injection molding produces a nearly finished golf ball, with clean up and painting typically being performed to finish the ball.

Most development of new golf balls is based on this two-piece architecture with the solid polybutadiene core, but adds various layers between the core and the outermost cover. Between two and six cover layers can be added. Some balls use an injection molded core or mantle layer (between the core and cover layers), but the majority of even the bestselling tour balls employs a compression molded polybutadiene core.

Most commercially available golf balls are made of nonmetallic rubbers and plastics, such as elastomers, ionomers, polyurethanes, polyisoprenes, nylons, and other similar materials. In recent years, however, golf balls with hollow metal cores have appeared in the market. This design takes advantage of the high stiffness of the metal core (when compared to the stiffness of typical golf ball materials) to produce a golf ball that has simultaneous characteristics of high accuracy (less hook and slice) as well as improved putting characteristics. These types of golf balls still have some shortcomings, including hard feel and a small loss of distance compared to more typical molded balls discussed above.

Simply using a metal in part of the golf ball is not sufficient to significantly increase the stiffness of the golf ball. Such designs suffer from several shortcomings including a hollow metal sphere design that is not durable enough to withstand impact forces when struck by a club. This can lead to permanent distortion.

Other recent developments do not provide a significantly higher stiffness in the core.

Accordingly, there is an ongoing and unmet need for golf balls having a high stiffness core that do not exhibit the shortcomings of existing golf balls.

BRIEF SUMMARY OF THE DISCLOSURE

A golf ball is provided with a high stiffness spherical core that is durable and capable of maintaining structural integrity and symmetry and which has good feel, rebound, and flight trajectory. The golf ball includes a spherical core and one or more outer layers surrounding the spherical core including, for example, a durable blended polymer that can withstand forces when compressed by a golf club. The spherical core is solid and can be a polymer matrix composite, a metal matrix composite, or a nanostructured material. In an example, the spherical core is a blend of components, wherein one of the components is an injection moldable polymer, a compression moldable polymer or elastomer, or a combination of both. A high modulus material, such as graphene, silicon carbide, silicon nitride, or another inorganic material or compound, also can be included in the spherical core. The outer layers surrounding the sphere can be an injection moldable polymer, a compression moldable polymer, or a blended polymer comprised of a blend of at least two components.

In one aspect, a golf ball comprises a cover layer and a spherical core. The cover layer has an outer surface with dimples and an inner surface opposite the outer surface that defines a cavity. The spherical core in the cavity comprises a polymer matrix composite and has a stiffness from 400 MPa to 200 GPa. The polymer matrix composite comprises an organic or an inorganic strengthening phase. The strengthening phase may be silicon nitride, silicon carbide, titanium diboride, titanium carbide, aluminum oxide, zirconium oxide, boron carbide, carbon fiber, carbon nanotubes, or graphene. The strengthening phase is from 5% weight to 80% weight of the spherical core. The polymer matrix composite comprises a polymer that is, for example, nylon, polyethylene, polystyrene, or acrylonitrile butadiene styrene (ABS). The polymer matrix also may include an elastomer. There may be at least one additional layer between the spherical core and the cover layer. The spherical core has an ATTI compression from 110 to 200 and a coefficient of restitution greater than 0.7.

In another aspect, a golf ball comprises a cover layer and a spherical core. The cover layer has an outer surface with dimples and an inner surface opposite the outer surface that defines a cavity. The spherical core in the cavity comprises a metal matrix composite and has a stiffness from 400 MPa to 200 GPa. The metal matrix composite comprises a metal and a strengthening phase. The metal may be iron, magnesium, titanium, aluminum, cobalt, molybdenum, tungsten, nickel, or alloys thereof. The strengthening phase may be silicon nitride, silicon carbide, titanium diboride, titanium carbide, aluminum oxide, zirconium oxide, boron carbide, carbon fiber, carbon nanotubes, or graphene. The strengthening phase is from 5% weight to 80% weight of the spherical core. There may be at least one additional layer between the spherical core and the cover layer. The spherical core has an ATTI compression from 110 to 200 and a coefficient of restitution greater than 0.7.

In another aspect, a golf ball comprises a cover layer and a spherical core. The cover layer has an outer surface with dimples and an inner surface opposite the outer surface that defines a cavity. The spherical core in the cavity comprises a nanostructured material and has a stiffness from 400 MPa to 200 GPa. The nanostructured material can include carbon steel, stainless steel, or titanium and have a grain size less than 1 μm. The nanostructured material also can include a nanometer-sized strengthening phase. There may be at least one additional layer between the spherical core and the cover layer. The spherical core has an ATTI compression from 110 to 200 and a coefficient of restitution greater than 0.7.

In another aspect, a method of making a golf ball is provided. A ceramic fiber is blended in a polymer using a multi-screw extruder for a defined amount of time configured to control stiffness of a spherical core such that the stiffness is from 400 MPa to 200 GPa.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural, logical, and process step changes may be made without departing from the spirit or scope of the disclosure. Accordingly, the scope of the disclosure is defined only by reference to the appended claims.

Disclosed herein are spherical cores used in golf balls that have a stiffness from 400 MPa to 200 GPa. Golf balls with this high stiffness spherical core provide better play characteristics. Higher stiffness cores affect spin rates (e.g., back spin, side spin, rifle spin), horizontal and vertical launch angle, and launch velocity.

The stiffness of the core may be attributed to the properties of the material used to construct the sphere (e.g., the hardness, modulus of elasticity, toughness, etc.). The stiffness of the core also may be attributed to whether the material is a metal, ceramic, polymer, elastomer, or composite of two or more of these and other materials. Surface features and the overall size and shape of the sphere, such as the moment of inertia, the section modulus, etc., are other factors that affect stiffness of the core. In addition, the properties of the polymers or other materials surrounding the spherical core affect the playing properties.

The golf balls disclosed herein have an outer cover with a dimpled pattern and a spherical core that has a stiffness of at least approximately twice or at least approximately five times that of a typical polybutadiene core found in a majority of golf balls on the market today. The stiffness of the golf balls disclosed herein may be less than that of a hollow metal core on the market today.

ATTI compression testing may be used to measure stiffness. ATTI compression testing measures deflection of a golf ball or a golf ball core when exposed to a force applied by a spring. The relationship between deflection and ATTI compression is shown in equation [1].

$$\text{ATTI compression}=200-(\text{Deflection}\times 1000) \quad [1]$$

A typical polybutidiene core has an ATTI compression less than 110. A typical hollow metal core has an ATTI compression greater than 190. The ATTI compression of the improved golf ball cores disclosed herein is from 110 to 200, including all values and ranges therebetween.

The golf balls disclosed herein may be two-piece golf balls in which instance the ball will consist of the cover with a hard spherical core. The golf balls disclosed herein also may be other multi-piece designs using greater than two pieces, e.g., three, four, five, etc. pieces, in which instance the sphere serves as the innermost spherical core. Thus, the spherical core disclosed herein can be used in any of the embodiments of FIGS. 1-4 or other golf ball designs.

Figure 1:
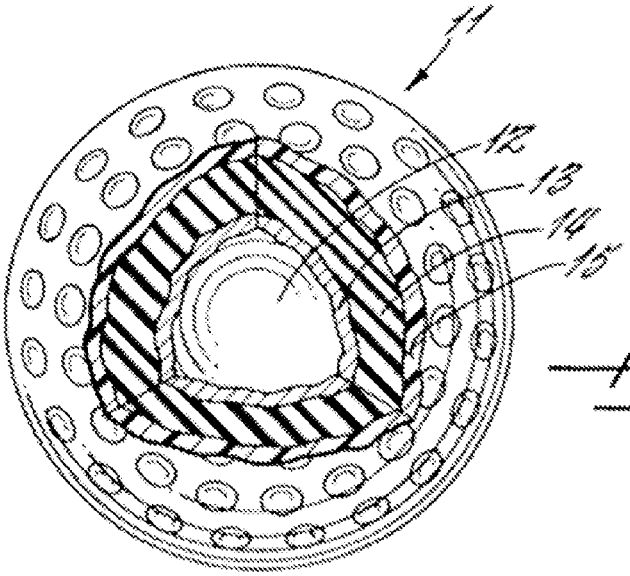
FIG. 1 is a partial cross-sectional perspective view of a golf ball including three elements: an innermost core comprised of a high stiffness sphere, a middle mantle layer, and cover layer.

FIG. 1 shows a golf ball 11 that includes a stiff spherical core 12 surrounded by a first polymer layer 13, which forms a two-part spherical body with surface 14. The two-part spherical body is surrounded by cover layer 15 that includes dimples or other surface features that are known in the art to improve flight characteristics. The cover layer 15 has an outer surface with dimples and an inner surface opposite of the outer surface that defines a cavity. The outer surface and inner surface of the cover layer 15 together define a cover thickness, which is about 4 mm, but may be any thickness between about 1 mm and about 6 mm, including all values and ranges therebetween, or between about 2 mm and about 5 mm. The cover layer 15 with the surface dimple pattern is made of a polymer sold under the trade name SURLYN® (manufactured by DuPont). In another example, the cover layer 15 is made of an ionomer, urethane, balata, polybutadiene, other synthetic elastomer, or any other material suitable for a golf ball cover. The cover layer 15 also forms the golf ball diameter. In an embodiment, the golf ball diameter is approximately 42.67 mm (1.68 inches), but may be any diameter equal to, greater than, or less than 42.67 mm that is capable of play. For example, USGA legal golf balls are 1.68 inches or greater in diameter. In an example, the golf ball diameter may be between about 40 mm and about 45 mm, including all values and ranges therebetween.

The diameter of the spherical core 12 may be any diameter from about 10 mm (0.39 inches) to about 38 mm (1.50 inches), including all values and ranges therebetween. For example, USGA legal golf balls with stiff cores have a core diameter less than or equal to 0.9 inches. In an example, the spherical core 12 of the golf ball 11 has a diameter less than about 31.75 mm (1.25 inches), including all values and ranges therebetween. In another example, the spherical core 12 of the golf ball 11 has a diameter less than or equal to about 22.86 mm (0.90 inches). In yet another example, the spherical core 12 has a diameter from approximately 0.9 inches to approximately 0.25 inches.

The second layer 14 is a polymer material, such as one or more of ethylene (meth)acrylic acid ionomers (such as DuPont's HPFTM resin), polyether block amide (such as the material sold under the trade name PEBAX® made by the Arkema Group), polybutadiene, or other materials known the art that are used in golf balls. The second layer 13 can be of molded construction. The second layer 14 generally has an outside diameter of about 1.52 to 1.60 inches (3.86 to 4.06 centimeters) and a thickness of 0.05 to 0.65 inches (0.13 to 1.65 centimeters), including all values and ranges therebetween. In another example, the second layer 14 has an outside diameter of about 0.21 to 0.55 inches (0.53 to 1.4 centimeters).

Figure 2:
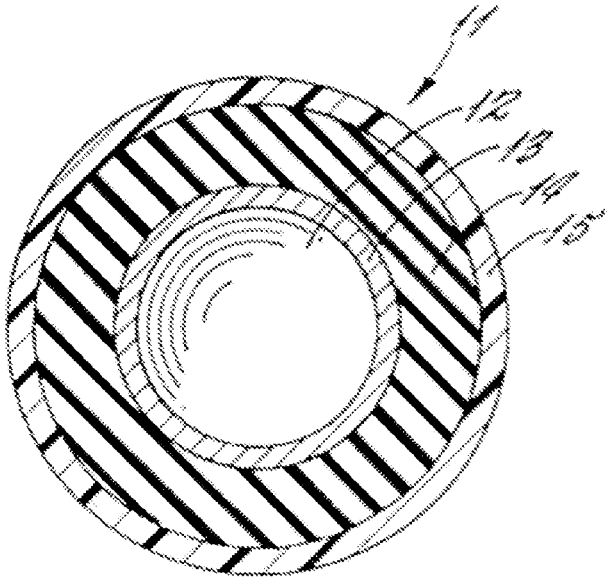
FIG. 2 is a cross-sectional view of a three-piece golf ball including three elements: an innermost core comprised of a high stiffness sphere, a middle mantle layer, and cover layer.

Another embodiment of the improved golf ball 11 is illustrated in FIG. 2. The golf ball 11 includes a stiff spherical core 12, surrounded by a thin first mantle layer 13, surrounded by a second mantle layer 14, and further surrounded by a cover layer 15.

Figure 3:
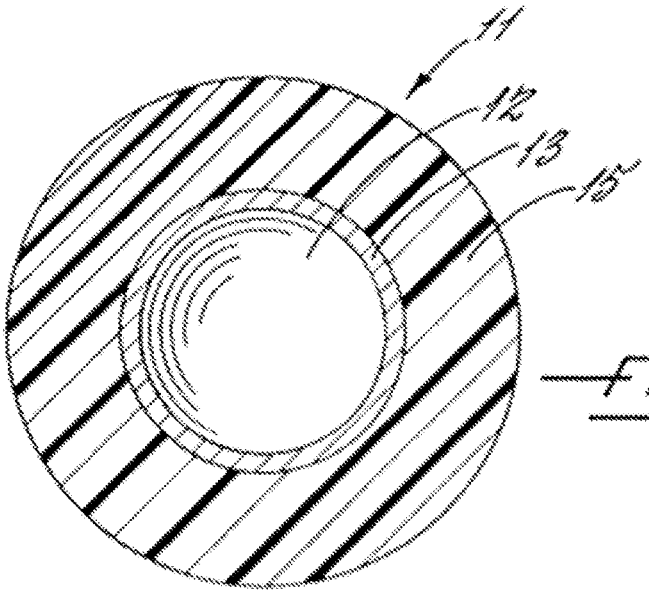
FIG. 3 is a cross-sectional view of a two-piece golf ball including two elements: an innermost core comprised of a high stiffness sphere, and a cover layer.

An additional embodiment of the improved golf ball 11 is illustrated in FIG. 3. The golf ball 11 includes a stiff spherical core 12, surrounded by a thin first mantle layer 13, and further surrounded by a cover layer 15. The golf ball 11 of FIG. 3 lacks the second mantle layer 14 illustrated in FIG. 2.

Figure 4:
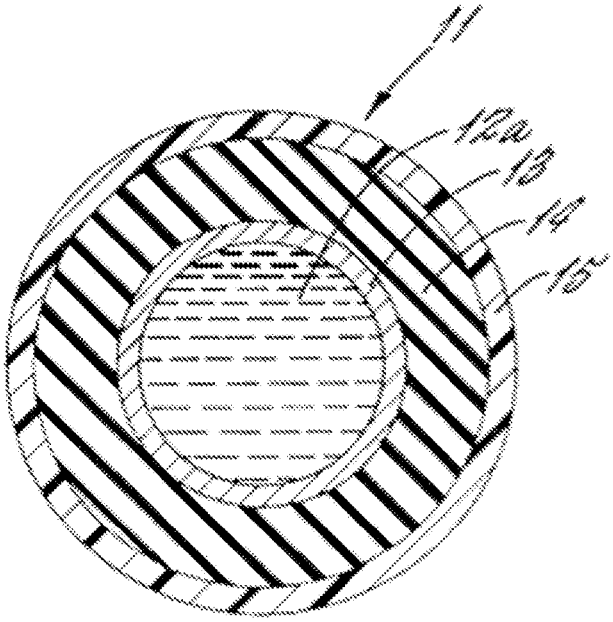
FIG. 4 is a cross-sectional view of a four-piece golf ball including four elements: an innermost core comprised of a high stiffness sphere, an inner mantle layer, an outer mantle layer, and cover layer.

Yet another embodiment of the improved golf ball 11 is illustrated in FIG. 4. The golf ball 11 includes a primary stiff spherical core 12*a*, a hollow spherical core 13 which surrounds the primary core 12*a*, surrounded by a mantle layer 14, and further surrounded by a cover layer 15. The hollow spherical core 13 may be metal or plastic. The primary spherical core 12*a* is a polymer matrix composite, metal matrix composite, or carbon matrix composite.

The dimensions of the golf ball 11 or the spherical core 12 in FIG. 1 may be used in some or all of the golf balls 11 or spherical cores 12, 12*a* of FIGS. 2-4.

The coefficient of restitution (COR) is typically measured when analyzing the playing performance of a golf ball, such as the golf balls of FIGS. 1-4. COR is a measure of the overall elasticity of a ball at a given impact speed and is tested by firing a ball (typically with an air cannon) at an immovable fixed body. The COR for the ball is calculated with the following equation [2]:

$$\text{COR}=\text{velocity of ball after impact}/\text{velocity of ball prior to impact} \quad [2]$$

The COR for the improved golf balls disclosed herein is greater than approximately 0.7. In an example, the COR for the improved golf balls disclosed herein is greater than 0.75. Use of a polymer matrix composite, metal matrix composite, or nanostructured material enables the COR to be optimized or tailored by adjusting various material properties. A stiffer material tends to have less deflection.

For most modern golf balls, the velocity of the ball after impact is typically around 20% less than the velocity of the golf ball immediately prior to impact with the fixed target. The loss in kinetic energy (i.e., velocity) that occurs during this impact is the result of a conversion to vibrational energy within the ball materials that are excited at impact and reduce in amplitude as they convert to heat at the molecular level. The ability to minimize or otherwise reduce vibrational losses will generally reduce the lost kinetic energy from the impact, thereby increasing the COR of the ball.

Another parameter that can play a role in the vibrational response of a golf ball is the ball's ability to dampen the vibrations caused by impact. Damping may be attributed to the properties of the materials surrounding or disposed within the spherical core, such as the density, viscosity, modulus of elasticity, coefficients of friction, etc., of the materials. The materials may be gases, pressurized or otherwise, liquids, gels, foams, solids, etc. Additionally, the state of the materials is also a consideration, such as whether the materials are pre-stressed. Any one of these parameters may be modified to tailor the vibrational response of the golf ball.

The following equation [3] describes the deflection of the three-piece golf ball 11 shown in FIG. 1 when struck during a high-impact collision. It should be noted that although the equation describes the deflection of a three piece ball, the analysis is equally valid for other types of balls by adding or reducing terms. For example, in the case of a two-piece ball one would set the portion relating to the mantle layer to zero.

$$D=(d_{cover}\times(F)+d_{mantle}\times(F)+d_{core}\times(F))\times F \quad [3]$$

where D is the total deformation of the ball (i.e., deflection of all layers), F is the force applied to the ball, $d_{cover}\times(F)$ is the deflection of the cover layer, $d_{mantle}\times(F)$ is the deflection of the mantle layer, and $d_{core}\times(F)$ is the deflection of the spherical core. The deflections of the cover, mantle, and core are all functions of the applied force, thickness of the layer, configuration, and materials of construction, respectively. The spherical core and a resilient mantle layer of a three piece golf ball tends to deflect in a linear manner for small loads, and becomes increasingly stiff and therefore non-linear as the load increases.

The deflection of each layer of a golf ball is related to its thickness and the layer's modulus (which can be a non-linear function with respect to applied force). The deflection for a particular layer can vary depending on the layer's composition.

The stiffness of the spherical core 12 or 12*a* shown in FIGS. 1-4 affects the playing performance of a golf ball. Thus, the stiffness of the spherical core can be a design tool to achieve certain performance characteristics in a golf ball. The stiffness of a hard core (when compared to the stiffness of a typical elastomeric or polymeric core) can be used as a design factor to control the COR and other performance characteristics of the golf ball. A designer can control COR by controlling the stiffness of the hard core, while creating a design regime that allows for fewer hooks and slices during play.

In an example, the stiffness of the spherical core 12 or 12*a* shown in FIGS. 1-4 is from approximately 400 MPa to approximately 200 GPa, including all ranges and values therebetween. In another example, the stiffness of the spherical core 12 or 12*a* shown in FIGS. 1-4 is from approximately 600 MPa to approximately 100 GPa. In yet another example, the stiffness of the spherical core 12 or 12*a* shown in FIGS. 1-4 is from approximately 1 GPa to approximately 100 GPa.

Stiffness of the spherical core is controlled through materials design. The golf balls disclosed herein provide improved performance characteristics including low side spin rate, long distance, and bite without adversely affecting rebound characteristics. The ball minimizes hook and slice when improperly hit. The design of the golf ball allows variations in the material and the size of the spherical core, second or other additional layers, and outer cover in order to optimize performance characteristics. For example, higher rifle spin or lower side spin can be affected by higher stiffness of the spherical core, which in turn can reduce hooks or slices. This higher stiffness also can produce an improved or optimal back spin.

In one example, golf balls are produced with a range of spin properties tailored to a particular player.

The golf balls disclosed herein may be made using processes and techniques such as injection molding and/or compression molding so that the ball will be spherical in shape, have equal aerodynamic properties, and have equal moments of inertia about any axis through its center. If nanostructured materials are incorporated into to a polymer that is injection molded, increasing the screw and back pressure during injection molding may improve dispersion of the material into the polymer.

Polymer Matrix Composites

One or more polymers and one or more strengthening phases may be used in a spherical core fabricated of a polymer matrix composite. There is no restriction on the type of material that can be used, except that the final composite must meet the design requirements (e.g., modulus, toughness, surface finish). These one or more polymers and one or more strengthening phases form a mixture that offers a set of properties not available in any one single material. Injection molding polymers for the current core composites include, but are not limited to, nylon, polyethylene, polystyrene, acrylonitrile butadiene styrene (ABS), and combinations thereof. Ceramics that can be used as the strengthening phase in the polymer matrix composite include, but are not limited to, for example, silicon nitride ($Si_3N_4$), silicon carbide (SiC), titanium diboride ($TiB_2$), titanium carbide (TiC), aluminum oxide ($Al_2O_3$), zirconium oxide ($ZrO_2$), boron carbide ($B_4C$), and combinations thereof. Carbon fiber, carbon nanotubes (CNTs), graphene, or other materials can be used as a strengthening phase and may provide significant stiffening of a polymer or elastomer when used in a polymer matrix composite as described above. Furthermore, elastomers may also be employed as the matrix or mixed with a polymer to provide the matrix.

In an embodiment, the spherical core consists of one or more polymers and one or more strengthening phases.

In an example, the strengthening phase is from approximately 5% weight to 80% weight of the spherical core, including all values and ranges therebetween. In another example, the strengthening phase is from approximately 10% weight to 60% weight of the spherical core.

In an embodiment, a polymer matrix core comprises one or more polymers including an ethylene (meth)acrylic acid ionomer (such as HPFTM resin made by DuPont), a polyether block amide (such as the material sold under the trade name PEBAX® made by the Arkema Group), urethane/polyurethane, and/or polybutadiene. Silicon carbide whisker (SiC—W) material is added to the polymer and/or elastomer which forms the composite core. The SiC—W material is between about 5% and 80% or about 10% to 60% by weight of the spherical core. The SiC—W may be added in the form of nanocomposites, for example SiC—W contained in a polymer carrier such as polypropylene or other polymer. The polymer composite core can comprise one or more layers. The golf ball may comprise one or more additional layers surrounding the core. If an intermediate layer or layers is used, it is surrounded by a cover that is made of a hard, durable polymer suitable for golf balls such as a polymer sold under the trade name SURLYN® (manufactured by DuPont). A golf ball according to this embodiment may have a higher coefficient of restitution and higher accuracy compared to traditional golf balls.

In another embodiment, a material set that comprises a polymer matrix composite is used. For example, a HPF resin from DuPont provides an injection molded matrix that is filled with ceramic particulate and/or fiber, such as silicon carbide (SiC) fibers and/or whiskers.

In one embodiment, the high stiffness spherical core is made of polybutadiene containing between 1-20% graphene by weight of the spherical core and is surrounded by a blended polymer layer, such as a mixture of ethylene (meth) acrylic acid ionomers (such as DuPont's HPFTM resin), which is surrounded by an ionomer cover that includes a dimple pattern on the outermost surface of the cover. Between about 1% and 80% by weight, including all values and ranges therebetween, or between about 10% and 60% by weight of the blended polymer layer of the polymer blend is polybutadiene.

In another embodiment, a composite spherical core is made of a blend of silicon nitride and mixture of ethylene (meth)acrylic acid ionomers (such as DuPont's HPFTM resin) and is surrounded by a blended polymer mantle layer, such as a mixture of ethylene (meth)acrylic acid ionomers (such as DuPont's HPFTM resin), which is surrounded by an ionomer cover that includes a dimple pattern. Between about 10% and 80 or between about 10% and 60% by weight of the composite blend is silicon nitride in the core. Between about 1% and 80 or between about 10% and 60% by weight of the polymer blend is polybutadiene in the mantle layer.

The polymer matrix composite can be manufactured by, for example, physical mixing or in-situ polymerization. In physical mixing, the strengthening phase is dispersed into a polymer matrix by methods such as ultrasound, high-speed shearing, or roll milling. Surfactants may be used as a wetting agent to improve dispersion. In-situ polymerization forces monomers to polymerize directly in the presence of fillers or additives. With in-situ polymerization, the dispersion of the strengthening phase is obtained on a molecular scale, allowing for greater mixing and segregation. Starting materials for preparation of the polymers and their composites can employ photo polymerization or condensation polymerization reaction steps. UV-induced polymerization can be accomplished with the aid of a conventional medium pressure UV lamp at 120 $Wcm^{-1}$ and photoinitiators. The final crosslinking of a pre-cured/condensed polymer composite matrix can be optionally heated in a temperature controlled oven. All preparative and modification steps or materials handling can be performed in controlled atmosphere.

In an example, a ceramic fiber is blended into a polymer using a multi-screw extruder for an amount of time to control stiffness of a spherical core such that the stiffness is from 400 MPa to 200 GPa.

Example 1

Three piece ball—Polymer composite core comprising a DuPont HPF 1000 or HPF 2000 resin blended with silicon carbide whiskers at a loading of 30% by weight, a second polymer layer comprising a polybutadiene elastomer, and a cover made of a polymer sold under the trade name SURLYN® (manufactured by DuPont). The core is constructed with an outside diameter of 0.90 inches (22.86 millimeters), polybutadiene with a layer thickness of 0.330 inches (8.38 millimeters) and cover made of a polymer sold under the trade name SURLYN® (manufactured by DuPont) with a thickness of 0.060 inches (1.52 millimeters). The total mass of the ball is 1.620 ounces (45.93 grams) with an outer diameter of 1.680 inches (42.67 millimeters.)

Example 2

Three piece ball—polymer composite core comprising a polyether block amide (e.g., the material sold under the trade name PEBAX® made by the Arkema Group) resin blended with silicon nitride fibers at a loading of 40% by weight, a second polymer layer comprising a DuPont HPF 1000 or HPF 2000 resin and an ionomer cover. The core is constructed with an outside diameter of 0.90 inches (22.86 millimeters), DuPont HPF 1000 or HPF 2000 with a layer thickness of 0.330 inches (8.38 millimeters) and a cover made of a polymer sold under the trade name SURLYN® (manufactured by DuPont) with a thickness 0.060 inches (1.52 millimeters). The total mass of the ball is 1.620 ounces (45.93 grams) with an outer diameter of 1.680 inches (42.67 millimeters).

Metal Matrix Composites

Metal matrix composites (MMC) is another class of composites that may be used to manufacture the stiff spherical core. The MMC is comprised of at least two constituent parts: a metal and a strengthening phase. Metals that can be used include, but are not limited to, iron and alloys such as carbon steels, alloy steels, and stainless steels, magnesium, titanium, aluminum, cobalt, molybdenum, tungsten, nickel, and alloy or mixtures of these and other metals. The strengthening phase can be another metal or a ceramic, organic, or other type of material. Ceramics that can be used as the strengthening phase in the metal matrix composite include, but are not limited to, silicon nitride ($Si_3N_4$), silicon carbide (SiC), titanium diboride ($TiB_2$), titanium carbide (TiC), aluminum oxide ($Al_2O_3$), zirconium oxide ($ZrO_2$), and boron carbide ($B_4C$). Other materials also may be used as or in the strengthening phase in the metal matrix composite. For example, hardened steel, hardened stainless steel, carbon fiber, carbon nanotubes (CNTs), graphene, and other materials may provide stiffening when used in a composite as described above.

In an embodiment, the spherical core consists of one or more metals and one or more strengthening phases.

In an embodiment, a hardened alloy of steel or stainless steel with an aluminum matrix may be used for a spherical core.

In an example, the strengthening phase is from approximately 5% weight to 80% weight of the spherical core, including all values and ranges therebetween. In another example, the strengthening phase is from approximately 10% weight to 50% weight of the spherical core. In yet another example, the strengthening phase is from approximately 10% weight to 30% weight of the spherical core.

Metal matrix composites can be manufactured using methods such as casting, pressure casting, hot pressing, hot isostatic pressing, sintering, pressureless sintering through injection molding, pressureless sintering through compression molding, or other processes known in the art.

In an example, the metal matrix composite is produced by mixing the strengthening phase into dry metal powders, pressing the powder mixture into a spherical shape, and then densifying the sphere through a combination of temperature and pressure using such processes as sintering, isostatic pressing, and hot pressing. In another example, the strengthening phase is mixed into a molten metal and the resulting mixture cast into a spherical or near-spherical shape using vacuum, gravity, or pressure assistance and subsequently cooled to a solid form. If needed, the solid form may be further reduced to final shape and size using machining, grinding, or other techniques.

Nanostructured Materials

Nanostructured materials are another class of materials that can be used to form a core or used in a composite material as described above. Extending micro structural refinement down to the range of nanometers causes a change in the characteristics of the bulk material and often results in significant property improvements. Nanostructured materials made with nanocrystalline grain sizes or dispersions have attributes not typically found in conventional materials with grain sizes on the order of tens to hundreds of micrometers. Nanostructured materials also can have, for example, different strength, hardness, formability, or resistance to crack propagation properties than conventional materials.

Nanostructured materials exhibit characteristics based on controlling the composition of the material at a sub-micrometer level, to vary the strength, stiffness, ductility, hardness, formability, crack propagation resistance, other physical and mechanical properties, or a combination thereof. For example, materials, including metals, such as carbon steel, stainless steel, and titanium with controlled grain sizes, may be used to make a spherical core of the golf ball with beneficial characteristics due to grain size. The grain size may be less than approximately 1 μm.

Composite nanostructured materials may also be used to modify the properties of the golf ball containing a hollow or solid metal sphere. For example, by varying the amount of a nanometer-sized strengthening phase (i.e., second phase dispersions) within a metal matrix composite, the strength and stiffness of the base material used for the sphere may be tailored. Strengthening phase materials of the polymer matrix composites or metal matrix composites disclosed herein may be used in nanostructured materials.

In an embodiment, the spherical core consists of one or more polymers and one or more strengthening phases or one or more metals and one or more strengthening phases.

Nanostructured materials may be manufactured using methods such as casting, pressure casting, hot pressing, hot isostatic pressing, sintering, pressureless sintering through injection molding, pressureless sintering through compression molding, or other processes known in the art.

Although the present disclosure has been described with respect to one or more particular embodiments, it will be understood that other embodiments of the present disclosure may be made without departing from the spirit and scope of the present disclosure. Hence, the present disclosure is deemed limited only by the appended claims and the reasonable interpretation thereof.

What is claimed is:

1. A golf ball comprising:

a cover layer having an outer surface defining a plurality of dimples and an inner surface opposite the outer surface that defines a cavity; and a spherical core disposed within the cavity, wherein the spherical core comprises a polymer matrix composite and has a stiffness from 400 MPa to 200 GPa, and wherein the polymer matrix composite comprises a polymer resin and silicon carbide whiskers at a loading of 30% by weight.

2. The golf ball of claim 1, wherein the polymer matrix composite comprises a polymer selected from the group consisting of nylon, polyethylene, polystyrene, and acrylonitrile butadiene styrene (ABS).

3. The golf ball of claim 1, wherein the polymer matrix composite comprises a polymer selected from the group consisting of an ethylene (meth)acrylic acid ionomer, a polyether block amide, urethane, polyurethane, and polybutadiene.

4. The golf ball of claim 1, wherein the polymer matrix composite comprises an elastomer.

5. The golf ball of claim 1, wherein the spherical core has an ATTI compression from 110 to 200.

6. The golf ball of claim 1, wherein the spherical core has a coefficient of restitution greater than 0.7.

7. The golf ball of claim 1, further comprising at least one additional layer between the spherical core and the cover layer.

8. A golf ball comprising:

a cover layer having an outer surface defining a plurality of dimples and an inner surface opposite the outer surface that defines a cavity; and a spherical core disposed within the cavity, wherein the spherical core comprises a polymer matrix composite and has a stiffness from 400 MPa to 200 GPa, wherein the polymer matrix composite comprises a polyether block amide and silicon nitride fibers at 40% by weight.

9. The golf ball of claim 8, wherein the spherical core has an ATTI compression from 110 to 200.

10. The golf ball of claim 8, wherein the spherical core has a coefficient of restitution greater than 0.7.

11. The golf ball of claim 8, further comprising at least one additional layer between the spherical core and the cover layer.

* * * * *